US008506157B2

(12) United States Patent
Courvoisier et al.

(10) Patent No.: US 8,506,157 B2
(45) Date of Patent: Aug. 13, 2013

(54) UNCOUPLING DEVICE FOR A TIMEPIECE MECHANISM AND A WATCH MOVEMENT COMPRISING THE SAME

(75) Inventors: Raphaël Courvoisier, Montmollin (CH); Alphonse Bron, Bassecourt (CH)

(73) Assignee: Monet Jaquet Droz S A, La Chaux-de-Fonds (CH)

( * ) Notice: Subject to any disclaimer, the term of this patent is extended or adjusted under 35 U.S.C. 154(b) by 621 days.

(21) Appl. No.: 12/715,913

(22) Filed: Mar. 2, 2010

(65) Prior Publication Data

US 2010/0226216 A1 Sep. 9, 2010

(30) Foreign Application Priority Data

Mar. 3, 2009 (EP) ..... 09154219

(51) Int. Cl.
*G04B 5/02* (2006.01)

(52) U.S. Cl.
USPC ..... 368/208; 192/69.81

(58) Field of Classification Search
USPC ..... 368/206, 207, 208
See application file for complete search history.

(56) References Cited

U.S. PATENT DOCUMENTS 6,409,379 B1 * 6/2002 Gabathuler et al. ..... 368/150
7,075,860 B2 * 7/2006 Dias ..... 368/77
7,287,901 B1 * 10/2007 Helfer et al. ..... 368/147

FOREIGN PATENT DOCUMENTS

CH 352 624 A 2/1961
CH 655221 B * 4/1986
EP 1 333 343 A1 8/2003

* cited by examiner

*Primary Examiner* — Renee Luebke
*Assistant Examiner* — Jason Collins
(74) *Attorney, Agent, or Firm* — Sughrue Mion, PLLC

(57) ABSTRACT

A vertical type uncoupling device, in particular in an automatic watch winding mechanism that includes an oscillating mass and a gear train connecting the oscillating mass to a barrel (9), wherein a gear train includes a direction reverser device (11, 12), a reduction gear (13, 14, 15, 16) and the uncoupling device (20). The uncoupling device includes two coaxial wheels (17, 7) that can be coupled in rotation in one direction owing to respective Breguet toothings (21, 22) arranged on the opposite flanks of the wheels. The coaxial wheel (17), which is mobile in the axial direction, is secured to a sliding arbour (18), which is mounted so as to rotate and slide in fixed bearings (24, 25). A return spring (26) includes an elastic strip that abuts against one end of the sliding arbour (18) to tend to engage and keep meshed the Breguet toothings. This design reduces friction and saves space. Other applications of this type of uncoupling device in a watch movement are described.

10 Claims, 4 Drawing Sheets

UNCOUPLING DEVICE FOR A TIMEPIECE MECHANISM AND A WATCH MOVEMENT COMPRISING THE SAME

This application claims priority from European Patent Application No. EP09154219.1 filed Mar. 3, 2009, the entire disclosure of which is incorporated herein by reference.

BACKGROUND OF THE INVENTION

The present invention concerns an uncoupling device for a timepiece mechanism, comprising two coaxial wheels that can be coupled with each other in rotation in at least one direction via respective coupling elements arranged on opposite flanks of said wheels, wherein one of the coaxial wheels, called the coupling wheel, is mobile in the axial direction and is biased by a return spring, which tends to mesh the coupling elements. The invention also concerns a watch movement that includes this type of device, particularly in an automatic winding mechanism.

In most current automatic winding mechanisms, the direction reverser device is formed by a pair of unidirectional coupling wheels arranged in parallel, for example wheels with rollers or clicks. The mainspring, in its wound state, rests on the reduction train, tending to rotate it in the opposite direction to the winding direction, but the reverser device locks this reverse rotation, thus preventing the mainspring from letting down like the retaining click that acts on the barrel ratchet in manually wound movements. This click is nonetheless retained in most automatically wound calibres to prevent the spring letting down when the automatic winding module is removed, but it has the drawback of causing a waste of energy during winding. This is why it tends to be omitted when the reverser device of the automatic winding mechanism can prevent the barrel from letting down.

However, it is then useful to provide an uncoupling device in the automatic winding train, to enable a watchmaker to let the barrel down manually, particularly when he is dismantling part of the movement. Further, this device is generally arranged so that it is automatically uncoupled when the barrel is wound manually, to avoid making the first elements of the automatic winding train rotate at high speed. The uncoupling may be lateral or vertical, depending upon the direction of movement of the mobile coupling device.

The uncoupling device is usually of the lateral type, wherein the coupling element moves laterally relative to the arbours of the automatic winding train. This mobile element is an intermediate wheel, which, in order to be released from the ratchet or an intermediate drive wheel of the ratchet, is carried by a lever associated with a manual control and a return spring. In some cases, the use of this type of lever system can create difficulties in the design of a watch movement, particularly from the point of view of lateral space requirement or the arrangement of pivots.

Another type of lateral uncoupling device uses a jumper spring, carried by a wheel and applied to the tip of the teeth of a star type toothed wheel. CH Patent No. 655221 illustrates the use of this type of device in combination with a second time zone indicator and the associated corrector device. The use of this type of jumper spring cannot be envisaged in an automatic winding train, since it would be too difficult to control manually.

CH Patent No. 352624 discloses a vertical type uncoupling device, i.e. that one that moves perpendicularly to the bottom plate of the movement, in combination with two types of automatic winding mechanisms. The vertical arbour of the uncoupling device is carried in a conventional manner by jewels in the bottom plate and the barrel bar. It carries the last wheel of the reduction gear, which has a Breguet toothing on the top surface thereof. Above the Breguet toothing, the coupling wheel provided with a corresponding Breguet toothing can rotate and slide on the vertical arbour and remains permanently meshed with an intermediate wheel engaged on the barrel ratchet. The coupling wheel further includes an hour wheel with a circular external groove. A tipping control lever, which ends in a fork, engaged in said circular groove, is stressed by a return spring to keep the Breguet toothings coupled or return them to a coupled position. By acting on the other end of this lever, the watchmaker can cause uncoupling to occur in order to let down the barrel. During manual winding, the Breguet toothings become uncoupled by themselves by overcoming the effect of the return spring.

A considerable drawback of the aforementioned design lies in the resistant torque caused by friction of the control lever in the groove of the coupling wheel, since this friction is exerted at some distance from the axis of rotation. Added to this is the requirement for careful lubrication. Another drawback is that the uncoupling device arbour occupies the entire top space comprised between the bottom plate and the barrel bar, preventing any other element from occupying part of this top space. Finally, the control lever and the attachment thereof to the bottom plate occupy space next to the uncoupling device.

SUMMARY OF THE INVENTION

The present invention mainly concerns an uncoupling device that largely avoids the drawbacks of the prior art, by means of a simple and compact design. The invention also concerns watch movements that incorporate this type of device in various manners.

Generally, the invention concerns an uncoupling device of the type indicated in the preamble, characterized in that the coupling wheel is secured to a sliding arbour, which is mounted so that it slides and rotates in fixed bearings.

This arrangement differs from the device illustrated by CH Patent No. 352624 mainly because of two advantageous features. First of all, since the coupling wheel is integral with the coupling device arbour, its height can be quite low, owing to the removal of the circular groove, yet it is still perfectly guided since it is the bearings, in proximity to the ends of the sliding arbour, which perform the guiding. Secondly, instead of being exerted on the coupling wheel and thus at some distance from the axis of rotation, the force of the return spring can advantageously be applied to one end of the sliding arbour, and thus at zero distance from the axis of rotation. Preferably, the return spring comprises an elastic strip that abuts directly against one end of the sliding arbour. The height of the uncoupling device assembly can thus be reduced.

According to other aspects of the invention, there are watch movements that include this type of uncoupling device, in particular in an automatic winding mechanism and/or in a manual winding mechanism, or even in the gear train of a second time zone indicator.

Other features and advantages of the present invention will appear more clearly in the following description of various embodiments, given by way of non-limiting examples, with reference to the annexed drawings, which show two such examples.

DETAILED DESCRIPTION OF VARIOUS EMBODIMENTS

Automatic winding mechanism 1 shown in FIGS. 1 to 4 includes in a conventional manner a rotating eccentric mass, which, when it rotates under the effect of the wearer's movements, winds the mainspring of the watch movement. In order to clarify the drawings, this eccentric mass is not shown. In this example, it is located away from the centre of the movement.

Figure 1:
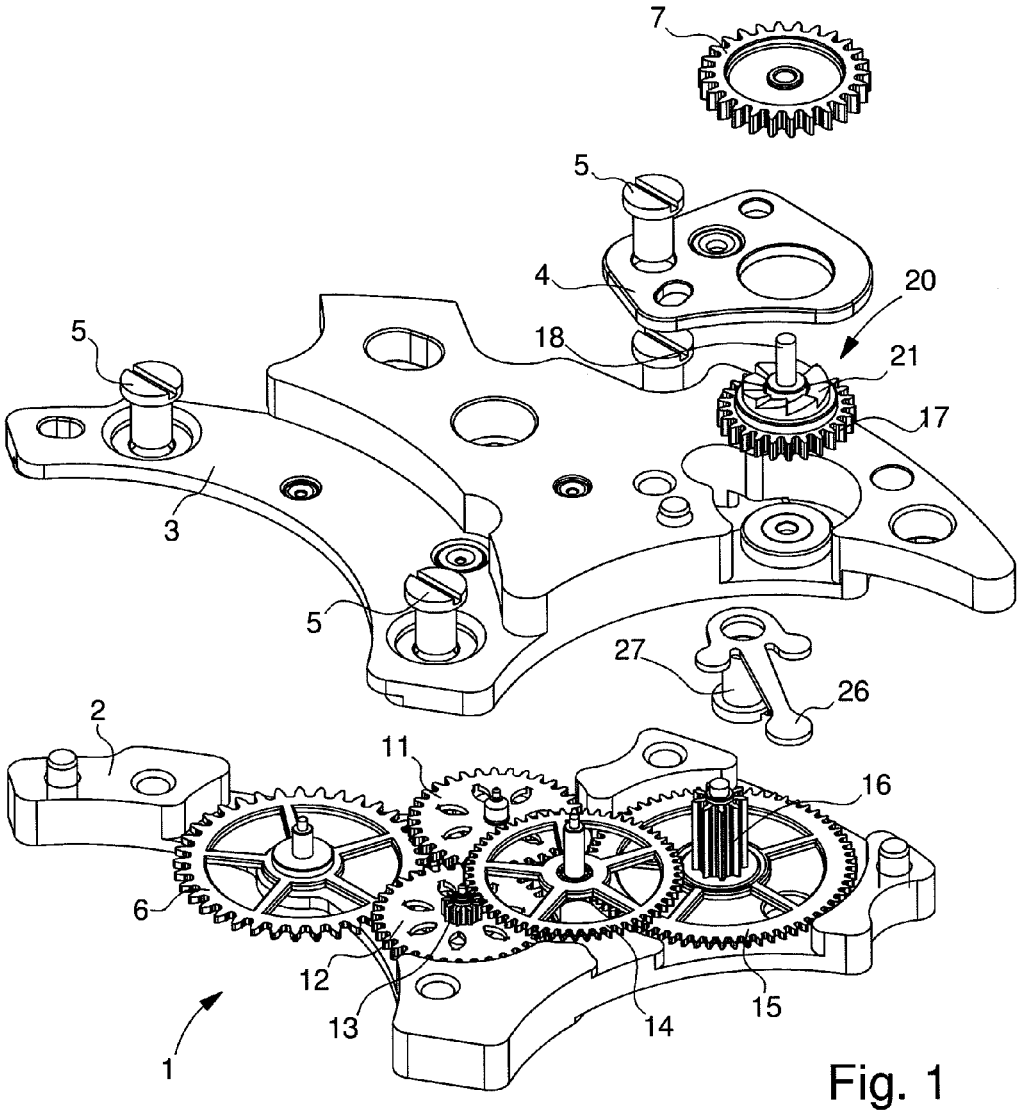
FIG. 1 is an exploded view showing the gear train of an automatic wristwatch winding mechanism, comprising a vertical uncoupling device in accordance with the invention.
Figure 2:
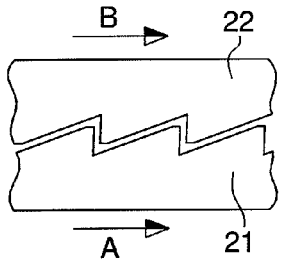
FIG. 2 is a diagram of the Breguet toothings used in the uncoupling device.

It will be noted, particularly in FIG. 1, that the gear train of mechanism 1 is made in the form of a module whose structure includes a frame 2, a bridge 3 and an additional plate 4, assembled by screws 5. The entry wheel of this gear train is an intermediate wheel 6, which is meshed with the pinion (not shown) integral with the eccentric mass, while the exit element is wheel 7 that drives ratchet 8 secured to staff 10 of barrel 9.

When it is rotating in one direction or another, intermediate wheel 6 drives a direction reverser device formed by a conventional pair of wheels with clicks 11, 12, whose exit pinion 13 rotates in a single direction and drives a reduction gear comprising two successive wheels 14 and 15. Wheel 15 is fitted with a long pinion 16 meshed on one coupling wheel 17, which is driven onto a coupling arbour 18. This arbour 18, which is mounted to rotate and slide into jewels 24 and 25 respectively carried by bridge 3 and barrel bar 31, is permanently pushed in the direction of the barrel bar (i.e. towards the top in FIG. 3) by a strip spring 26 secured to bridge 3 by means of a screw 27. As the end of arbour 18 is preferably convex, the torque due to friction of the spring when the arbour is rotating is practically zero and there is no problem of lubrication. Arbour 18 can slide along its rotation arbour 19, when it is biased, against the force of spring 26, which is relatively weak. This sliding enables an uncoupling device 20, which includes Breguet toothings 21 and 22, i.e. with saw-teeth, arranged respectively on the opposite flanks of wheels 17 and 7, to work. Drive wheel 7 is mounted so that it can rotate and slide on arbour 18. Apart from the particular case illustrated in FIG. 4, its central hub 7*a* is held abutting against jewel 25 via the force of spring 26, generating a friction torque, which is low owing to the small diameter of hub 7*a*.

Uncoupling device 20 is called a vertical device because its mobile coupling element 17 moves in the direction of its arbour 19, termed "vertical" because it is perpendicular to the general plane of bottom plate 30 of the timepiece movement.

Figure 3:
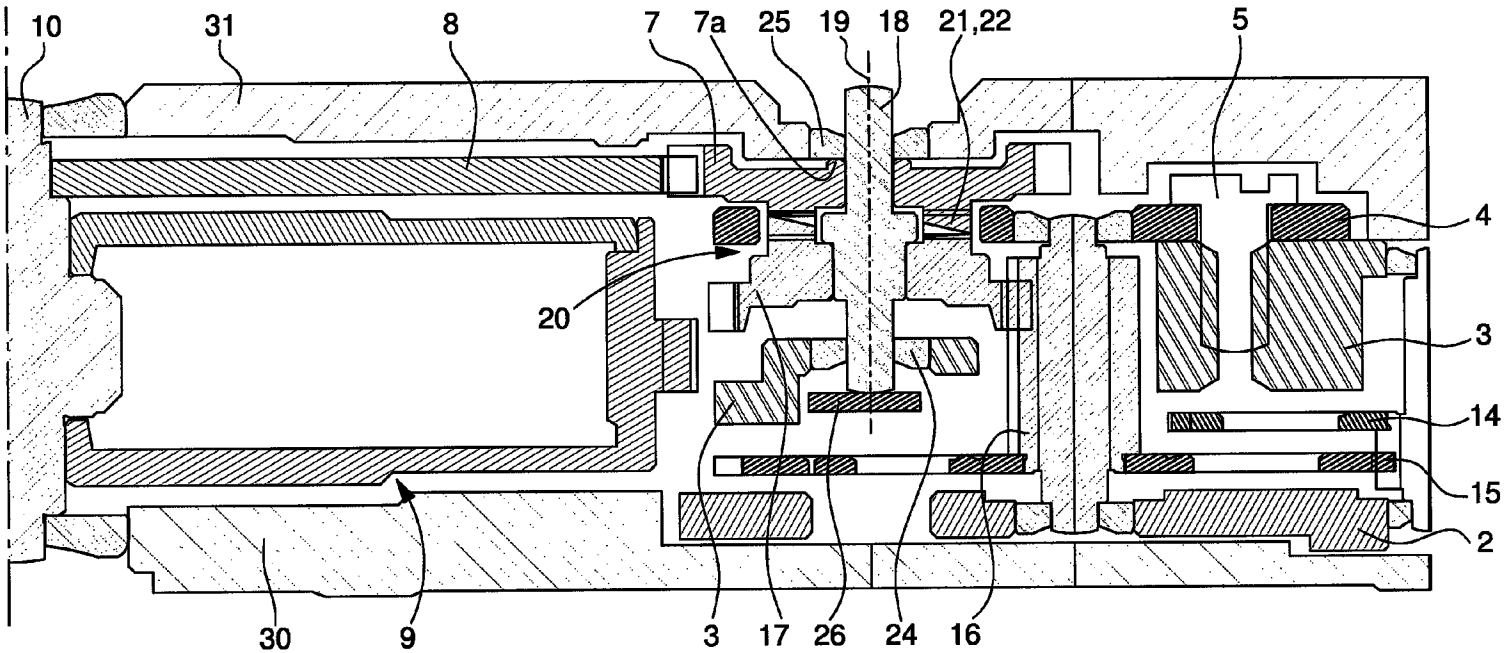
FIG. 3 is a cross-section of the mechanism shown in FIG. 1, in the coupled state, with the dial side at the bottom.

It will be noted in FIG. 3 that the total height of coupling wheel 17 can be much lower than in the case of CH Patent No. 352624, both because the circular groove has been omitted and because the stability of the wheel is ensured by its attachment to arbour 18, which is carried by bearings that are sufficiently spaced apart. This allows the height of the uncoupling device and its arbour 18 to be reduced, and releases a space between the arbour and frame 2 that can be used for enlarging wheel 15 of the reduction gear.

During normal operation of the watch, the mechanism is in the state shown in FIG. 3. The slight axial thrust of return spring 26 against the end of coupling arbour 18 keeps coupling wheel 17 abutting against ratchet drive wheel 7, with the Breguet toothings engaged in each other as shown in the FIG. 2 diagram. When the oscillating mass of the automatic winding mechanism is rotating, it rotate Breguet toothing 21 in the direction of arrow A, which drives Breguet toothing 22 in the direction of arrow B by abutment of the vertical surfaces of the teeth and thus rotates wheel 7, ratchet 8 and staff 10 to wind the mainspring.

This state changes when the watch is wound manually, since this operation rotates ratchet 8 and drive wheel 7, while coupling wheel 17 is generally not rotating at that time. Wheel 7 thus becomes the driving wheel and wheel 17 is kept stopped by the remainder of the gear train, provided that the effect of spring 26 is sufficiently weak. The movement of toothing 22 in the direction of arrow B, causes the slightly inclined flanks of Breguet toothings 21 and 22 to slide over each other pushing coupling wheel 17 axially against the force of spring 26, such that the automatic winding mechanism is momentarily uncoupled until the manual winding action stops. The uncoupling prevents the manual winding from rotating the automatic winding train and thus driving click wheels 11 and 12 at high speed. Next, spring 26 automatically returns uncoupling device 20 to the coupled state after each passage of teeth in uncoupling device 20. There is, therefore, no risk of the barrel accidentally being let down.

Figure 4:
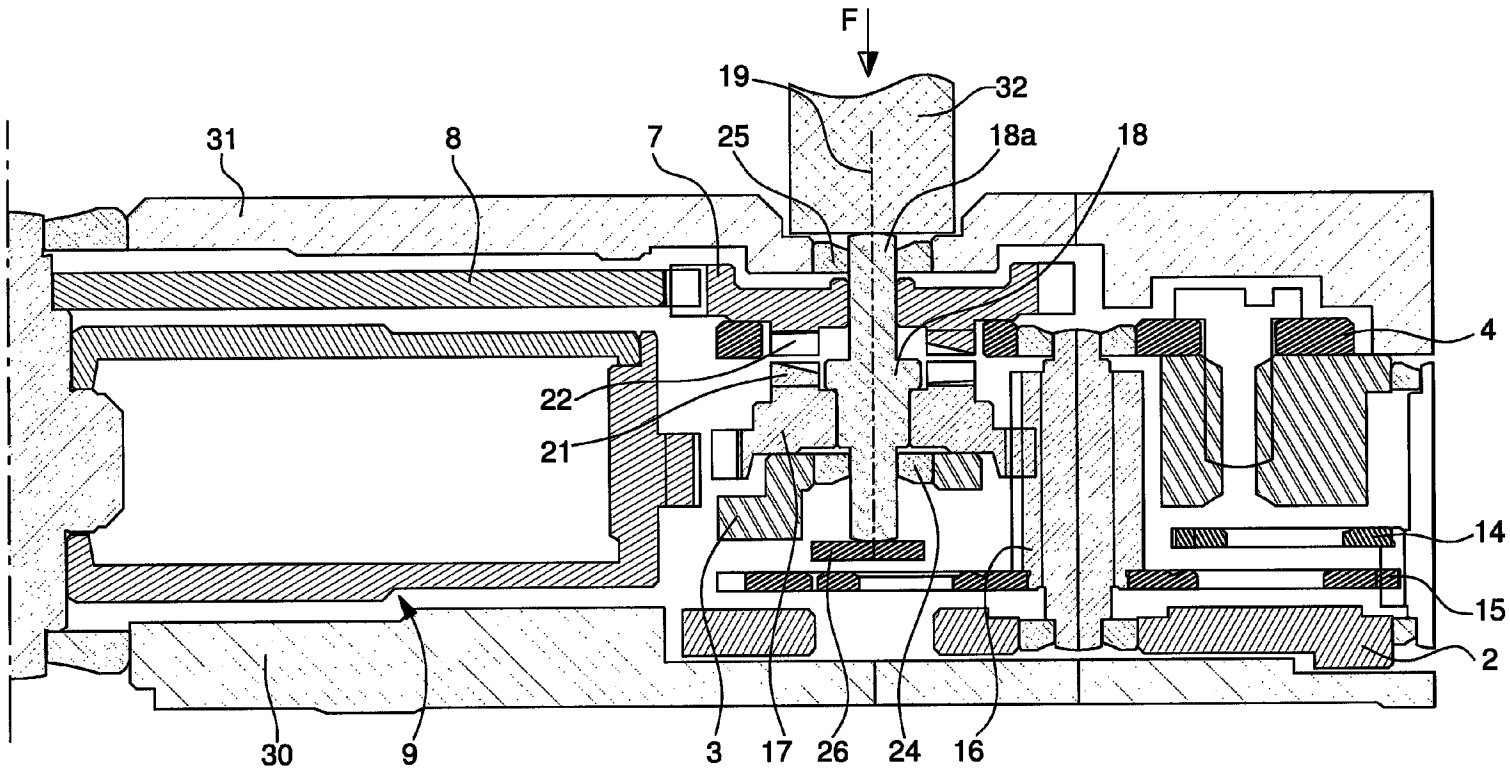
FIG. 4 is a similar view to FIG. 3, showing the mechanism in a manually uncoupled state.

FIG. 4 shows the case of manual intervention by a watchmaker to uncouple the automatic winding train when barrel 9 has to be let down, for example when the movement is being dismantled. The thrust of spring 26 has simply to be overcome by exerting an axial force F on the end 18*a* of arbour 18 that projects beyond the corresponding bearing 25, for example with a tool 32 or a weight, while the winding stem is being held, so that the barrel is not instantaneously let down. When arbour 18 moves down, as seen in the drawing, drive wheel 7 is retained by plate 4, coupling wheel 17 remains meshed with pinion 16, Breguet toothings 21 and 22 are completely released from each other and wheel 7 is uncoupled. The abutment of coupling wheel 17 against bar 3 stops the axial movement. The watchmaker can then gradually let the winding crown rotate to gradually let down the barrel. It will be noted that the watchmaker does not need to touch spring 26 and is not likely to impart any excessive deformation thereto.

In the light of the above example, those skilled in the art may observe that the present invention provides an automatic watch winding mechanism with a simpler and more reliable design than the prior art, whilst reducing energy wasted due to friction and saving space.

Of course, the design of the uncoupling device may differ from what is shown in the diagrams without departing from the scope of the invention claimed here. For example, instead of Breguet toothings 21 and 22, other types of joined coupling elements could be provided, as long as at least one of these elements has a ramp-shaped part on which the joined element can slide or roll to push the coupling wheel against the force of the spring in one of the rotational directions of the device.

Another application of a vertical uncoupling device according to the invention consists in incorporating it in a manual winding train, thus connecting a winding stem to the mainspring by acting, for example, on ratchet 8 shown in FIGS. 3 and 4. This uncoupling device may be of a similar design to that of the preceding example. It can coexist with the latter in an automatic watch, thus preventing the automatic winding device from rotating the winding crown, a function that is usually performed by a lateral uncoupling device.

Figure 5:
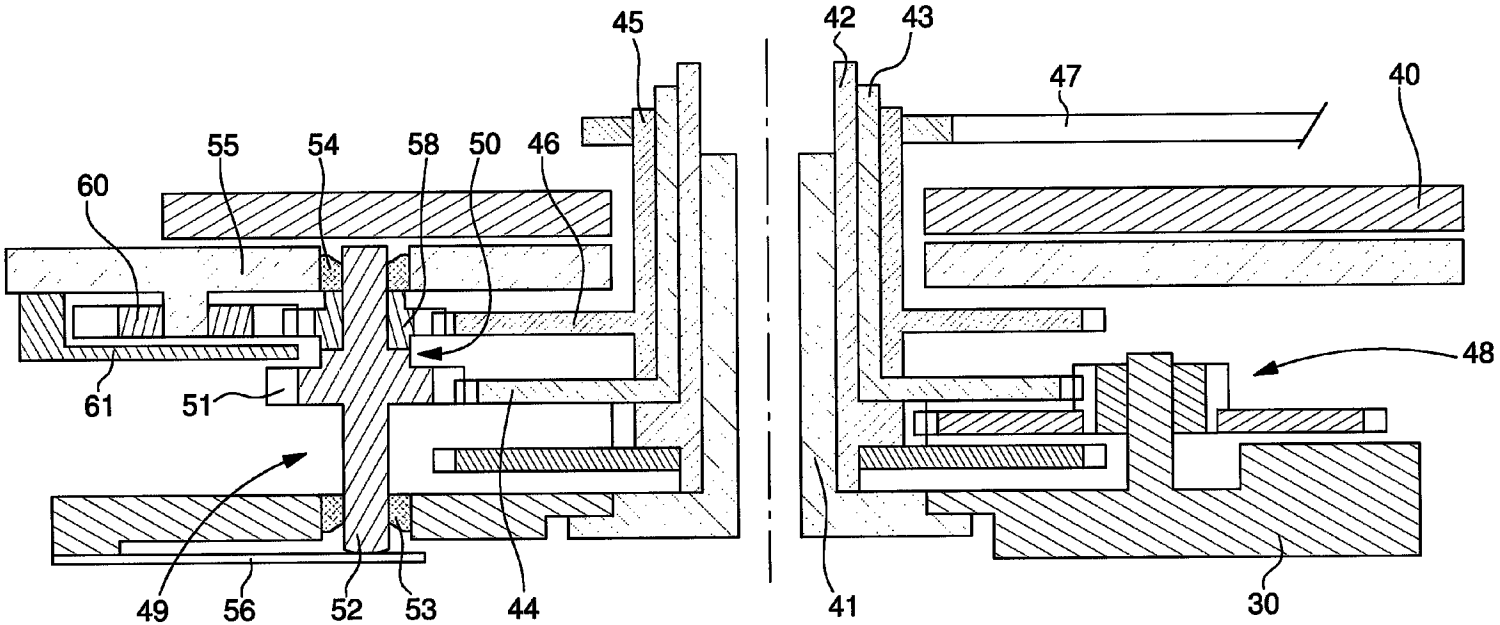
FIG. 5 is a schematic, vertical cross-section of a display train comprising an uncoupling device according to the invention, associated with a time zone corrector.

Another embodiment of the invention is illustrated in FIG. 5, which shows schematically a train for displaying the time on a watch dial 40, with an additional hand for indicating the time in a second time zone. A centre tube 41 secured to bottom plate 30 carries concentric rotating elements that include: the cannon-pinion 42 fitted with the minute hand (not shown), an hour wheel pipe 43 fitted with the normal hour hand (not shown), and the hour wheel 44, and an additional hour wheel pipe 45 fitted with a wheel 46 and a second time zone hand 47, which cooperates with a twenty-four hour scale on dial 40. The hour wheel 44, which makes two revolutions per day, is driven by the pinion of cannon-pinion 42 via a conventional motion work 48. The hour wheel drives time zone wheel 46 at the rate of one revolution per day via an intermediate gear train 49, which includes an uncoupling device 50 according to the present invention. Thus, intermediate train 49 performs in turn the two functions of reducing transmission and uncoupling.

The entry element of the uncoupling device is coupling wheel 51, whose arbour 52 is mounted so as to rotate and slide in bearings 53 and 54 formed by jewels in bottom plate 30 and a holding plate 55. Arbour 52 and wheel 51 are permanently pushed in the direction of the dial by a strip-spring 56 applied against the end of arbour 52. The toothing of wheel 51 is wide enough to remain meshed with wheel 44 when arbour 52 is sliding. The exit element of the uncoupling device is a drive wheel 58, which is meshed, with time zone wheel 46 and with an intermediate wheel 60 that forms part of a time zone corrector. Wheel 58 pivots on arbour 52 and is retained axially between jewel 54 and a limiting bridge 61. As in the preceding example, wheels 51 and 58 of uncoupling device 50 include respective coupling elements, which are arranged on opposite flanks of said wheels and which are held coupled by the slight axial thrust of spring 56. These elements are formed by example by coupling toothings that have symmetrical inclined flanks so that they can transmit the rotation of hour wheel 44 to hand 47 in both directions, particularly when the time of the watch is being set, and become uncoupled in both directions. When there is a change of time zone, the action of the user on the corrector rotates intermediate wheel 60, drive wheel 58, time zone wheel 46 and hand 47 in one direction or the other, whereas a corresponding rotation of coupling wheel 51 is prevented by hour wheel 44. The inclined surfaces of the coupling elements of the uncoupling device push coupling wheel 51 against the thrust of spring 56, so that the second time zone indicator is thus momentarily uncoupled from the timepiece movement and can rotate manually by one hour steps (or half-hour steps in some cases), with the coupling elements forming a notch mechanism which corresponds to the successive time zones.

What is claimed is:

1. An uncoupling device for a timepiece mechanism, including two coaxial wheels that can be coupled to each other in rotation in at least one direction owing to respective coupling elements arranged on opposite flanks of said wheels, wherein one of the coaxial wheels, being a coupling wheel, wherein said coupling wheel is mobile in the axial direction and biased by a return spring that tends to mesh the coupling elements, wherein the coupling wheel is rotatably coupled to a sliding arbour that is mounted so as to rotate and slide in fixed bearings.

2. The device according to claim 1, wherein the return spring includes an elastic strip that abuts against one end of the sliding arbour.

3. The device according to claim 2, wherein the sliding arbour includes, on the opposite side to the return spring, a first arbour end that projects relative to a bearing into which said first arbour end is mounted, for pushing said arbour manually to uncouple the device.

4. The device according to claim 1, wherein the coupling elements include a Breguet toothing, on at least one of said coaxial wheels.

5. The device according to claim 1, wherein said bearings are formed by timepiece jewels.

6. A watch movement including an uncoupling device for a timepiece mechanism, including two coaxial wheels that can be coupled to each other in rotation in at least one direction owing to respective coupling elements arranged on opposite flanks of said wheels, wherein one of the coaxial wheels, being a coupling wheel, wherein said coupling wheel is mobile in the axial direction and biased by a return spring that tends to mesh the coupling elements, wherein the coupling wheel is rotatably coupled to a sliding arbour that is mounted so as to rotate and slide in fixed bearings.

7. The watch movement according to claim 6, wherein the uncoupling device is incorporated in an automatic winding mechanism that includes an oscillating mass and a gear train connecting the oscillating mass to a mainspring, wherein said gear train includes a reduction gear train arranged for rotating in a single direction and the uncoupling device.

8. The watch movement according to claim 7, wherein said gear train includes a direction reverser device upstream of the reduction gear.

9. The watch movement according to claim 6, wherein the uncoupling device is incorporated in a manual winding train connecting a winding stem to a sprung barrel.

10. The watch movement according to claim 6, wherein the uncoupling device is incorporated in a gear train that connects an hour wheel to a second time zone indicator.

* * * * *